US005551082A

United States Patent [19]

Stewart et al.

[11] Patent Number: 5,551,082

[45] Date of Patent: Sep. 3, 1996

[54] PROTECTIVE ATHLETIC PANTS HAVING DIAGONAL PROTECT PADS AROUND HIP, BUTTOCKS AND THIGH AREAS

[75] Inventors: David H. Stewart, New York; Sheila C. Lehner, Brooklyn, both of N.Y.

[73] Assignee: Crash Pads, Inc., Hillsboro, Oreg.

[21] Appl. No.: 394,042

[22] Filed: Feb. 24, 1995

Related U.S. Application Data

[63] Continuation of Ser. No. 227,786, Apr. 14, 1994, abandoned, which is a continuation of Ser. No. 7,489, Jan. 25, 1993, abandoned, which is a continuation-in-part of Ser. No. 2,599, Jan. 11, 1993, abandoned.

[51] Int. Cl.[6] ..... A41D 13/00

[52] U.S. Cl. ..... 2/2; 2/227; 2/228; 2/238; 2/267

[58] Field of Search ..... 2/2, 22, 23, 24, 2/227, 228, 238, 214, 215, 267, 268, 51

[56] References Cited

U.S. PATENT DOCUMENTS

| | | | |
|---|---|---|---|
| 3,909,847 | 10/1975 | Holt et al. | 2/2 |
| 3,991,420 | 11/1976 | Savarino | 2/2 |
| 4,441,211 | 4/1984 | Donzis | 2/2 |
| 4,462,115 | 7/1984 | Carlson et al. | 2/2 |
| 4,507,801 | 4/1985 | Kavanaugh et al. | 2/2 |
| 4,538,301 | 9/1985 | Sawatzki et al. | 2/2 |
| 4,700,407 | 10/1987 | Mattila | 2/267 |
| 4,805,243 | 2/1989 | Gibbens et al. | 2/228 |
| 4,894,867 | 1/1990 | Ceravolo et al. | 2/228 |
| 4,961,233 | 10/1990 | Black | 2/238 |
| 5,067,175 | 11/1991 | Gold | 2/2 |

*Primary Examiner*—C. D. Crowder
*Assistant Examiner*—Gloria Hale
*Attorney, Agent, or Firm*—Kenneth R. Schaefer

[57] ABSTRACT

An athletic garment designed to protect the wearer from injury during athletic activity such as in-line roller skating, skiing, volleyball, mountain biking, basketball, hockey, field hockey, ice skating or gymnastics. The invention uses strategically placed and rib-shaped gel, air or elastic foam padding to protect the wearer from the impact and abrasion of a fall caused by such activity.

16 Claims, 2 Drawing Sheets

PROTECTIVE ATHLETIC PANTS HAVING DIAGONAL PROTECT PADS AROUND HIP, BUTTOCKS AND THIGH AREAS

This is a continuation, of application Ser. No. 08/227,786, filed Apr. 14, 1994, and now abandoned which, in turn, is a continuation of application Ser. No. 08/007,489, filed Jan. 25, 1993, which is a continuation-in-part of U.S. patent application Ser. No. 08/002,599, filed Jan. 11, 1993, each of which is abandoned.

TECHNICAL FIELD

The invention relates to a garment designed to protect the wearer from injury during athletic activity such as in-line roller skating, skiing, volleyball, mountain biking, basketball, hockey, field hockey, ice skating or gymnastics.

BACKGROUND ART

This invention concerns a solution to a problem encountered by many sports enthusiasts. The problem is injury to an athlete's body, including but not limited to the athlete's hips, coccyx, or buttocks, resulting from athletic activity such as volleyball, mountain biking, basketball, hockey, field hockey, ice skating, gymnastics or in-line roller skating. In performing these sports, athletes often fall backward or on their sides, many times causing serious injury and/or a cessation to the sport. The cause of the problem is a lack of adequate safety equipment available to the public. Existing protective padding tends to be restrictive, insufficient, or gives the illusion of obesity. Prior patents have addressed related problems, however, this invention presents a unique approach to solving each of these problems.

U.S. Pat. No. 2,266,886 describes a pair of thigh pads of the type used in the sport of football. The pads are not permanently affixed to any garment and are designed to protect the thigh. The pads contain a stiff board-like element. The present invention is distinguished by the affixed nature of its pads, the location of its pads, and the flexibility of the wearer due to the pliable nature of its pads.

U.S. Pat. No. 2,247,961 discloses a pair of shoulder pads and thigh pads of the type used in the sport of football. The pads are stiff and utilize inflatable sections. The shoulder pads are attached to the wearer using straps. The thigh pads are inserted into a pocket inside the wearer's pant leg over the thigh. The present invention is distinguished by the affixed nature of its pads to the garment, the location of its pads in relation to the garment and the wearer, and the flexibility of the wearer due to the pliable nature of its pads. Additionally, the present invention helps eliminate the illusion of obesity by locating its pads completely on the outside of the garment.

U.S. Pat. No. 4,810,559 describes the use of a plurality of platelets attached in a web like pattern to a garment. The object of the invention is to protect the wearer from scratches. The instant invention is different because it protects the wearer from the impact and abrasion of a fall. In addition, the instant invention uses foam, gel, air or elastic pads to absorb impact.

U.S. Pat. No. 4,961,233 discloses a design for cycling pants. The patent relates to a reinforced liner which is not a safety feature. It is dissimilar to the Protective Athletic Pants disclosed herein because the present invention utilizes padding to protect its wearer from the impact and abrasion of a fall.

U.S. Pat. No. 5,014,354 describes a device designed primarily to prevent abrasions. The device involves the general use of parallel strips of cushioning material, which yield in the direction of relative motion between the user's body and an abrading surface, to absorb friction related energy. It does not claim to protect against impact. In contrast, the present invention protects against impact and abrasion to fixed strategic locations throughout the lower torso and other body regions. Its protective pads are composed of foam, gel, air or elastic foam to absorb impact. In contrast to the 5,104,354 patent, the instant invention uses gel, air or a coated, hard, outer surface or abrasion resistant fabric to reduce friction by deflecting abrasive materials. The 5,104,354 patent claims to protect the wearer by absorbing friction related energy.

U.S. Pat. No. 5,038,408 describes the use of patches to reinforce conventional work pants. The primary object of that design is to increase the life of the pants and reduce abrasion. The 5,038,408 patent uses patches of leather and foam sewn to the pants to reduce abrasion. The present invention uses thicker gel, air or elastic foam pads to protect against impact and abrasion to fixed strategic locations on the wearer's lower torso. The coated, hard, outer surfaces of the pads deflect friction. The present invention protects against athletic falls, not prolonged abrasion, which is the object of the 5,038,408 patent.

U.S. Pat. No. 5,105,473 describes an athletic garment that uses removable pads to protect against impact. The garment, however, fails to provide a means to prevent abrasion. In contrast to the 5,105,473 patent, the pads of the present invention are fixed in shape and location to maximize protection and mobility. The present invention provides protection against abrasion, while the loose fit of the 5,105,473 garment would tend to promote it. Moreover, the present invention helps eliminate the illusion of obesity by locating the pads completely on the outside of the garment.

SUMMARY OF THE INVENTION

The present invention relates to a garment designed to protect the wearer from injury during athletic activity such as in-line roller skating, skiing, volleyball, mountain biking, basketball, hockey, field hockey, ice skating or gymnastics. The padding can be accomplished by means of foam, gel or air. The gel or air padding is accomplished by containing said gel or air a non-porous, stretchable covering such as a balloon or bladder apparatus affixed to the garment. The balloon or bladder can be affixed by means of a suitable adhesive or tacking. Although the invention can be applied to garments protecting the wearer's upper torso and limbs, the embodiment described herein applies the invention to shorts that protect the wearer's hips, coccyx, buttocks, and lower torso generally. The invention comprises a generally tubular garment such as shorts or above-the-knee pants made of elasticized or other stretch material (such as LYCRA spandex®), with strategically placed padding to protect the wearer from impact or abrasion resulting from a fall during the performance of a sport such as in-line roller skating, skiing, volleyball, mountain biking, basketball, hockey, field hockey, ice skating or gymnastics. An object of the invention is to provide comfortable and aesthetically pleasing protection to the wearer during sporting activities.

There currently exists for sports clothing padded and armored knee pads and protective wrist guards. Existing equipment is designed to protect the wearer's extremities during a forward fall. The present invention, however, is designed to protect the wearer from injury during a forward, side or backward fall. The invention, as applied to protect the lower torso, and as illustrated herein, provides protection to the wearer's hips, coccyx, and buttocks. This protection can be provided by strategically placed foam, gel, air, thermoformed or die cut, closed cell, high density foam pads that are affixed to the garment with at least one layer of fabric intervening between the pad and the wearer's body.

As applied to protect the lower torso, the invention uses a plurality of rib-like pads that are affixed to elasticized or LYCRA spandex® fabric shorts in parallel with each other and positioned substantially in line with the contour of each of the buttocks. These pads protect the wearer's hips and buttocks. A triangular pad is positioned over the coccyx to protect the wearer's coccyx and lower spine. The pads are positioned and shaped to minimize restriction of movement. The pads are thick enough to protect the wearer, but thickness is limited by a concern for aesthetics and agility.

The foam, gel or air composing the pads can be affixed to the garment with or without an encompassing outer elasticized or LYCRA spandex® fabric shell. The gel or air is contained in a non-porous elasticized envelope such as a balloon or bladder which comprises the outer surface of the pad. The wearer can control the thickness of the gel or air pads by determining the desired amount of gel or air to insert into the balloon or bladder. The outer front surface of each pad, in either event, can be coated with a hardened, but flexible substance such as polyethylene, vinyl laminate, or an epoxy based paint or abrasion resistant nylon fabric. This coated surface improves the padding in several regards. First, it provides a hardened surface to distribute the impact of concentrated objects such as rocks or a curb. Second, it allows the wearer to slide upon impact rather than absorbing the initial shock of the fall. Third, the coating protects the pad and/or garment from contact with abrasive surfaces such as pavement. The coating substantially prolongs the life of the garment by preventing wear and tear. And finally, the coating provides an aesthetically pleasing, finished look and may include contrasting designs and color, including high visibility colors for safety.

The protective pads do not impede the aesthetic value of the garment since they are interrupted and are separated by a fabric surface which conforms snugly to the wearer's body, presenting the appearance of being on the outside surface of the garment. Normally, a padded garment would tend to make the wearer appear overweight due to the shear bulk of the padding. The present invention, however, avoids such an appearance by affixing the pads so they appear to be on the outer surface of the garment. The garment forms and clings to the shape of the wearer. The pads are distinctly attached and displayed as outside padding. A person viewing the wearer can easily distinguish the wearer's shape versus the outside padding. This design eliminates the illusion of obesity inherent in other designs.

DETAILED DESCRIPTION OF THE PREFERRED EMBODIMENT

Referring to FIGS. 1, 2, 3 and 4, the preferred embodiment of the invention is comprised of an athletic garment shown as a pair of protective fabric shorts 12 (preferably made of stretchable material such as LYCRA spandex® fiber), which can be manufactured and sized to fit a wide spectrum of users. The shorts 12 are equipped with a number of strategically placed rib-shaped pads 11, 13.

Figure 1:
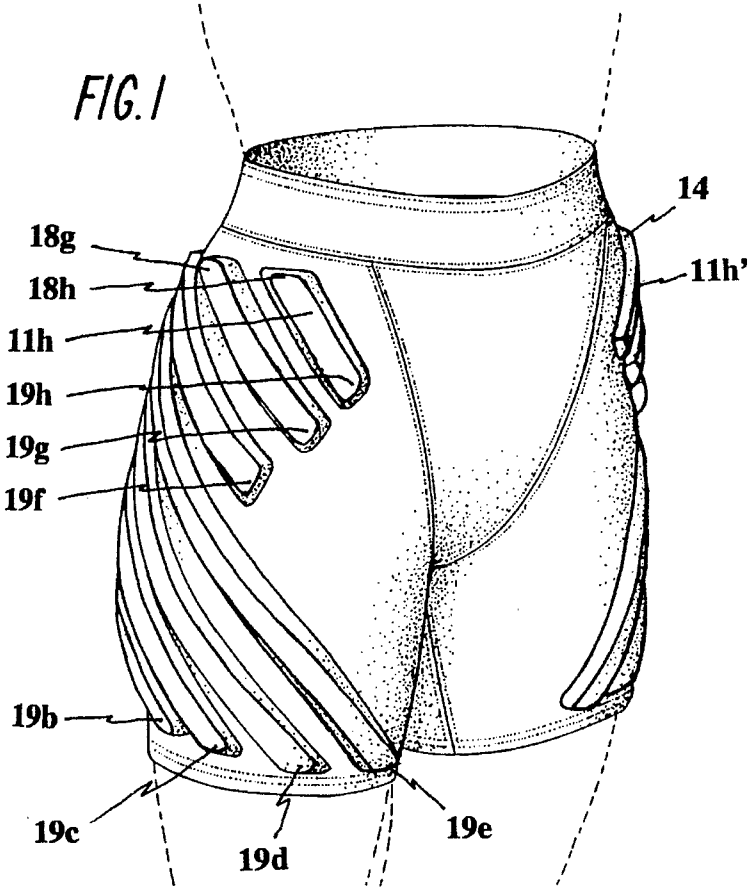
FIG. 1 is a rotated front view of the invention showing the form fitting characteristics of its elasticized fabric construction. This view illustrates the padded garment according to the invention on the front and side of the person wearing it.
Figure 2:
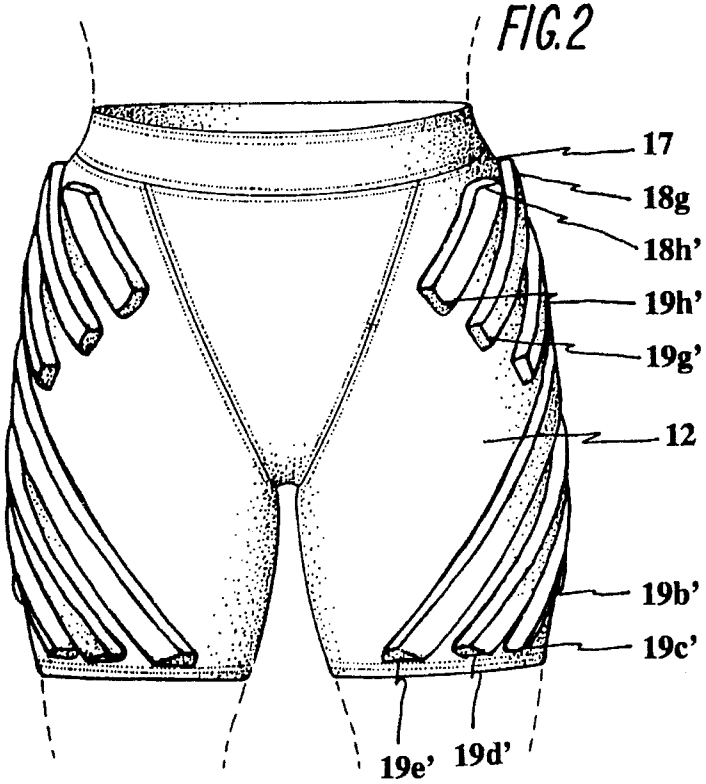
FIG. 2 is a front view of a padded garment according to the invention showing the strategic placement and shape of the shock absorbent padding. This view illustrates the garment on the front of the person wearing it.
Figure 3:
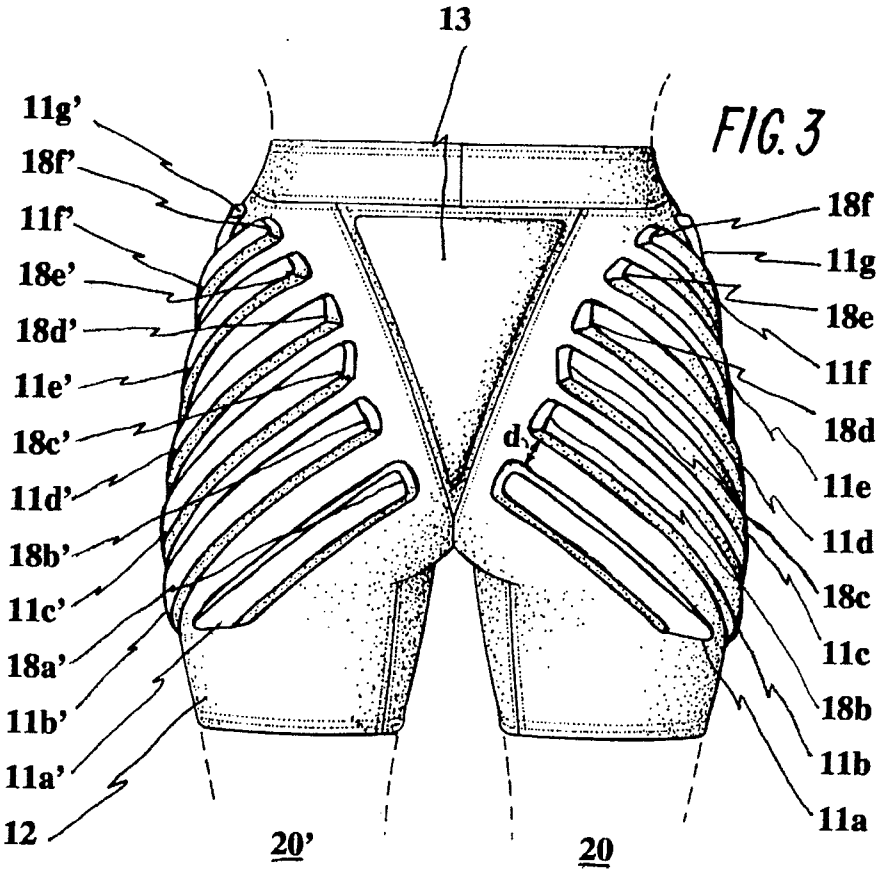
FIG. 3 is a rear view of a padded garment according to the invention showing the form fitting characteristics of a Lycra® fabric construction and the strategic placement and shape of the shock absorbent padding. This view illustrates a padded garment according to the invention on the back of the person wearing it.
Figure 4:
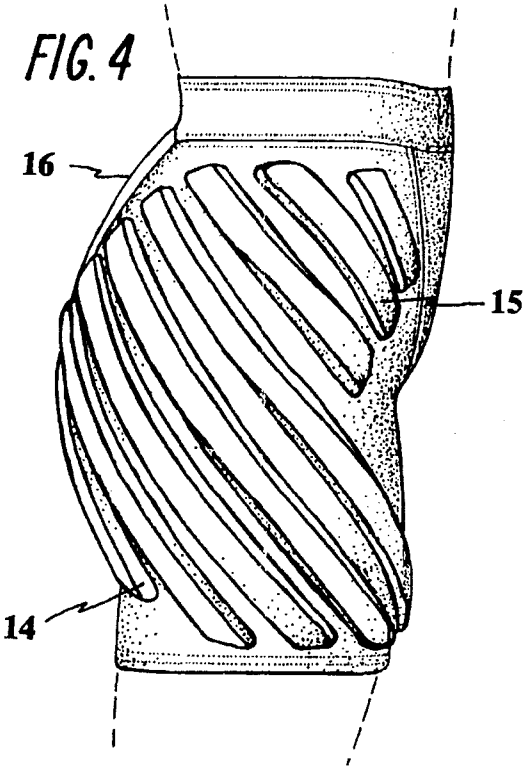
FIG. 4 is a side view of a padded garment according to the invention showing the form fitting characteristics of a LYCRA spandex® fabric construction and the strategic placement and shape of the shock absorbent padding. This view illustrates a padded garment according to the invention on the side of the person wearing it.

A plurality of pads 11*a*–11*h* and 11*a*'–11*h*', shaped and positioned as illustrated, are affixed to the shorts 12. The pads 11 are parallel to each other and are positioned in line with the contour of each of the buttocks of a user as shown in FIGS. 3 and 4. A single triangular pad 13 is affixed to the shorts 12 in a position covering the wearer's coccyx as shown in FIG. 3. The pads 11, 13 are positioned and shaped to minimize restriction of movement of the wearer's lower torso and legs. The pads 11, 13 have a thickness 14 sufficient to protect the wearer, but thickness 14 is limited by a concern for aesthetics and agility. The thickness of the pads which use gel or air may be controlled by the wearer.

Referring more specifically to FIGS. 3 and 4, it can be seen that the individual pads 11 are arranged in two mirror-image sets 11*a*–11*h* and 11*a*'–11*h*', the sets being disposed, respectively on the right and left halves of the wearer's anatomy in a pattern which is symmetrical with respect to a central vertical axis lying along the spine of the wearer. The pads 11*a*–11*h*, 11*a*'–11*h*' are spaced apart by a distance "d" (typically less than the width of an individual pad) and extend diagonally from an upper, rearwardly disposed end 18*a*–18*h*, 18*a*'–18*h*' to a lower, forwardly disposed end 19*a*–19*h*, 19*a*'–19*h*'. The pads 11*a*–11*h*, 11*a*'–11*h*' overlay the buttocks, hip and upper leg portions of the wearer. At least some of the pads (e.g., 11*b*–11*e*, 11*b*'–11*e*') are relatively longer and extend from the rear of the wearer's leg 20, 20' to the lower end 21, 21' of the leg portion of the garment 12 at the side or front of the leg 20, 20'. Others of the pads (such as 11*a*, 11*a*') are of relatively shorter length and are disposed substantially entirely in the rear portion of the garment 12 in the vicinity of the buttocks. The remainder of the pads (such as 11*f*–11*h*, 11*f*'–11*h*') are relatively shorter in length and are disposed in the vicinity of the forward portion of the hip of the wearer.

The upper ends 18*f*–18*h*, 18*f*'–18*h*40 generally are disposed just below the waist of the wearer. The upper ends 18*a*–18*e*, 18*a*'–18*e*' of the remaining pads diverge away from the central vertical axis along the wearer's spine and an additional triangular pad 13, arranged to provide significant protection to the coccyx and spinal area, is disposed between those upper ends.

The protective pads 11 and 13 preferably are composed of gel, air or thermoformed, closed cell, high density foam and are illustrated encased by a layer of, for example, LYCRA spandex® material. In the case of foam pads, the inner foam is highly elastic to promote the absorption of collision related energy. The pads 11, 13 provide the wearer with protection from the impact and abrasion of a fall. The pads 11, 13 are affixed onto the outer surface of the shorts 12 either mechanically or with adhesive. For example, the pads 11, 13 may be placed in the appropriate position on the shorts 12, fastened thereto with a suitable adhesive or by "tacking" with thread and thereafter, an additional layer or layers of similar or contrasting color Lycra® fabric and a wear surface (see below) are sewn to the pants 12 immediately around the edges of the pads 11, 13 and along the edges of the similarly shaped inner piece of fabric which forms pants 12.

The outer surfaces 15, 16 of each of the pads 11, 13 (or of the overlying fabric where used) preferably are coated with a hardened, relatively smooth substance such as polyethylene, vinyl laminate, or an epoxy based paint, or abrasion resistant nylon. The coated surfaces 15, 16 improve the pads 11, 13 in several regards. First they provide hardened surfaces to distribute the impact of concentrated objects such as rocks or a curb. Second they allow the wearer to slide upon impact rather than absorbing the initial shock of the fall. Third, the coatings protect the pad material from contact with abrasive surfaces such as pavement. The coating substantially prolongs the life of the garment 12 by preventing wear and tear. And finally, the coating provides an aesthetically pleasing, finished look and, for example, includes a high visibility color for safety and aesthetic reasons.

The protective pads 11, 13 do not adversely affect the aesthetic value of the garment 12 since they are located completely on an outside surface 17 of garment 12. Normally, a padded garment would tend to make the wearer appear overweight due to the shear bulk of the padding. The present invention, however, avoids such an appearance by affixing the pads on the outer surface 17 of the shorts 12. The shorts 12 when fabricated of elasticized or stretch material such as LYCRA spandex® material form and cling to the shape of the wearer. The pads 11, 13 are distinctly attached and displayed as outside padding. A person viewing the wearer can easily distinguish the wearer's shape from outside padding. This design eliminates the illusion of obesity inherent in other designs.

While the invention has been described in terms of a preferred embodiment, other configurations may occur to persons skilled in this art in the light of the foregoing teachings, which configurations may also fall within the scope of the invention as set forth in the following claims.

What is claimed is:

1. A garment for use in sports activities comprising:

a substantially tubular, body covering portion of stretchable fabric adapted to be worn by a person engaged in a sports activity;

impact absorbing protective means comprising a plurality of rib-shaped pads, said pads being located on an outer surface of said body covering portion for protecting the wearer in the event of a fall, said pads comprising at least a first plurality of relatively narrow, elongated diagonal pads each commencing at an upper end in the vicinity of a wearer's waist and curving, when worn, around the wearer's hip bones, and a second plurality of relatively narrow, elongated, diagonal pads each terminating at a relatively forwardly disposed lower end substantially in line with the lower portion of the buttocks of a wearer, said second plurality of pads having relatively rearwardly disposed upper ends below the waist of the wearer.

2. A garment according to claim 1, wherein said rib-shaped pads are diagonally disposed on said garment and said pads extend from an upper rearwardly disposed end to a lower forwardly disposed end and curve around the outside of a wearer's leg.

3. A garment according to claim 2, wherein said protective pads are specifically positioned to protect at least the hip and buttocks of a wearer against side or backward falls.

4. A garment according to claim 3 wherein said tubular body covering portion comprises a pair of shorts and said pads are affixed to said pair of shorts.

5. A garment according to claim 4 wherein said plurality of elongated protective pads are affixed to said shorts substantially in spaced apart parallel relation with each other and are positioned in line with the contour of each of the buttocks.

6. A garment according to claim 5 and further comprising a triangular pad of impact absorbing material positioned to rest over the coccyx.

7. A garment according to claim 3 wherein the outer surface of each pad is coated with a hardened substance selected from the group consisting of polyethylene, vinyl laminate, nylon and an epoxy-based paint.

8. A garment according to claim 4 wherein each protective pad is encased by a layer of spandex material.

9. A garment according to claim 3 wherein each pad is encased by a non-porous, stretchable covering.

10. A garment according to claim 9 wherein each protective pad is composed of a gel.

11. A garment according to claim 9 wherein each protective pad is composed of air.

12. A garment according to claim 4 wherein each protective pad is composed of closed cell, high density foam.

13. A garment according to claim 2 wherein said upper rearwardly disposed ends of at least some of said protective pads extend to the vicinity of the wearer's spine and upper ends of others of said pads overlay the wearer's hip bones.

14. A garment according to claim 3 wherein said lower forwardly disposed ends of said at least some of said pads extend to a lower extremity of said garment.

15. A garment according to claim 1 wherein said means for affixing said pads comprises an adhesive between said pads and the outer surface of said garment.

16. A garment according to claim 1 wherein said means for affixing said pads comprises a piece of stretchable fabric overlaying each said pad and sewn to the outer surface of said garment.

* * * * *